US007506396B2

(12) United States Patent
DiPippo

(10) Patent No.: US 7,506,396 B2
(45) **Date of Patent: *Mar. 24, 2009**

(54) SELF-CLEANING HAIR BRUSH

(76) Inventor: Joe J DiPippo, 36 Manchester Rd., Eastchester, NY (US) 10709

( * ) Notice: Subject to any disclaimer, the term of this patent is extended or adjusted under 35 U.S.C. 154(b) by 199 days.

This patent is subject to a terminal disclaimer.

(21) Appl. No.: 11/431,310

(22) Filed: May 10, 2006

(65) Prior Publication Data

US 2007/0261187 A1 Nov. 15, 2007

(51) Int. Cl.

| | |
|---|---|
| ***A46B 3/08*** | (2006.01) |
| ***A46B 7/02*** | (2006.01) |
| ***A01K 13/00*** | (2006.01) |
| ***A45D 24/42*** | (2006.01) |
| *A46B 17/06* | (2006.01) |

(52) U.S. Cl. ..... 15/169; 15/184; 119/628; 132/119

(58) Field of Classification Search ..... 15/169, 15/184; 132/119; 119/628, 629
See application file for complete search history.

(56) References Cited

U.S. PATENT DOCUMENTS

| | | | | | |
|---|---|---|---|---|---|
| 1,280,204 | A | * | 10/1918 | Garber | 119/629 |
| 1,303,500 | A | * | 5/1919 | Rosenberg | 15/246 |
| 2,486,203 | A | * | 10/1949 | Pieper | 15/203 |
| 2,916,757 | A | * | 12/1959 | Kaye et al. | 15/184 |
| 3,059,260 | A | * | 10/1962 | Peilet | 15/184 |
| 3,108,305 | A | * | 10/1963 | Peilet | 15/169 |
| 3,110,053 | A | * | 11/1963 | Surabian | 15/159.1 |
| 3,577,580 | A | * | 5/1971 | Rand | 15/169 |
| 4,517,703 | A | * | 5/1985 | Koke | 15/246 |
| 5,267,528 | A | * | 12/1993 | Murieen, Sr. | 119/628 |
| 5,519,912 | A | * | 5/1996 | Kawamura | 15/160 |
| 5,904,150 | A | * | 5/1999 | Caristo et al. | 132/119 |
| 6,427,633 | B1 | | 8/2002 | Ogden | |
| 6,725,495 | B1 | * | 4/2004 | Habibi | 15/160 |

* cited by examiner

*Primary Examiner*—Joseph J Hail, III
*Assistant Examiner*—Alvin J Grant
(74) *Attorney, Agent, or Firm*—Edwards Angell Palmer & Dodge LLP

(57) ABSTRACT

A hair brush with a cleaning element for removing entwined hair from the brush after use. The cleaning element of the brush includes a plate(s) with opening through which the bristles protrude. When the plate is expanded, the plate pushes any hairs entwined in the bristles to the tips of the bristles where they are removed. The brush also has a post mechanism, which allows for the adjustment of the cleaning element to various intermediary positions, effectively adjusting the length of the bristles for use of the brush.

15 Claims, 8 Drawing Sheets

SELF-CLEANING HAIR BRUSH

FIELD OF THE INVENTION

The present invention relates to a self-cleaning hair brush that removes hair from the bristles of a hair brush in a thorough and convenient manner.

BACKGROUND OF THE INVENTION

Hair brushes are notoriously difficult to clean. The more bristles a brush has, perhaps the more effective the brush is as a tool, but also, the more difficult it is to clean. The use of brushes with self-cleaning capabilities of known designs and configurations is known in the prior art. More specifically, brushes with self-cleaning capabilities of known designs and configurations previously devised and utilized for the purpose of cleaning matter from the bristles of brushes through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,631,831 to Loiselle discloses a retractable bristle brush for removing hair from hair brushes. U.S. Pat. No. 5,862,563 to Hartmann discloses a removable cleaning plate for removing hair from hair brushes. U.S. Pat. No. 4,084,282 to Calvert discloses a power operated rotary brush for removing hair from hair brushes.

While these devices fulfill their respective, particular objectives and requirements, the aforementioned patents do not describe a self-cleaning hair brush that allows automatically removing hair from the bristles of a hair brush in a thorough and convenient manner.

In this respect, the self-cleaning hair brush according to the present invention substantially departs from the conventional concepts and designs of the prior art, and in doing so provides an apparatus primarily developed for the purpose of automatically removing hair from the bristles of a hair brush in a thorough and convenient manner.

Therefore, it can be appreciated that there exists a continuing need for a new and improved self-cleaning hair brush, which can be used for automatically removing hair from the bristles of a hair brush in a thorough and convenient manner. In this regard, the present invention substantially fulfills this need.

SUMMARY OF THE INVENTION

In view of the foregoing disadvantages inherent in the known types of brushes with self-cleaning capabilities of known designs and configurations now present in the prior art, the present invention provides an improved self-cleaning hair brush. As such, the general purpose of the present invention, which will be described subsequently in greater detail, is to provide a new and improved self-cleaning hair brush, which has all the advantages of the prior art and none of the disadvantages.

To attain this, the present invention is a hair brush with sliding parts (cleaning element) for hair removal. The hair brush has a brushing element supporting a plurality of bristles and a cleaning element having openings through which the bristles protrude. To use the brush, the cleaning element can be positioned at various distances from the brushing element to affect long or short bristles. To clean the hair brush, the cleaning element is fully extended (maximum cleaning position) away from the brushing element so that any hairs entwined in the bristles are forced to or off the tips of the bristles. The brushing element has a hollow body and the cleaning element is attached to a sleeve and is further supported by a plate lifter (rib arm), which is disposed within the brushing elements hollow body.

The brush has a control element used for adjusting the cleaning element to the various brushing positions and the cleaning position. Adjustment of the control element moves the cleaning element relative to the brushing element. Specifically, the control element pulls the plate lifter (rib arm) within the brushing element propelling outward or inward until the cleaning element is in the desired position relative to the bristles. In one embodiment of a brush in accordance with the invention, a spring assembly means is provided for elastically urging the cleaning element(s) inwardly along the direction of the bristles, thereby speeding the return of the cleaning element(s) to a use position following a cleaning of the brush. In another embodiment, the brush includes a sleeve/spacer assembly means for elastically urging the cleaning element(s) inwardly along the direction of the bristles. A control element can be operable in both the lock means for releasably and lockably selecting and the sleeve/spacer means. The control element can be operable along the long direction of the brush. It is also contemplated that the control element can enable a ready positioning of the cleaning element(s) to establish at least the first and second use-lengths of the bristles.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved self-cleaning hair brush, which has all of the advantages of the prior art brushes with self-cleaning capabilities of known designs and configurations and none of the disadvantages.

It is another object of the present invention to provide a new and improved self-cleaning hair brush, which may be easily and efficiently manufactured and marketed.

It is further object of the present invention to provide a new and improved self-cleaning hair brush, which is of durable and reliable constructions.

An even further object of the present invention is to provide a new and improved self-cleaning hair brush which is susceptible of a low cost of manufacture with regard to both materials and labor, and which accordingly is then susceptible of low prices of sale to the consuming public, thereby making such self-cleaning hair brush economically available to the buying public.

The above, and other objects, features and advantages of the present invention will become apparent from the following description read in conduction with the accompanying drawings, in which like reference numerals designate the same elements.

BRIEF DESCRIPTION OF THE DRAWINGS

The same reference numerals refer to the same parts throughout the various Figures.

DESCRIPTION OF THE PREFERRED EMBODIMENT

Figure 1:
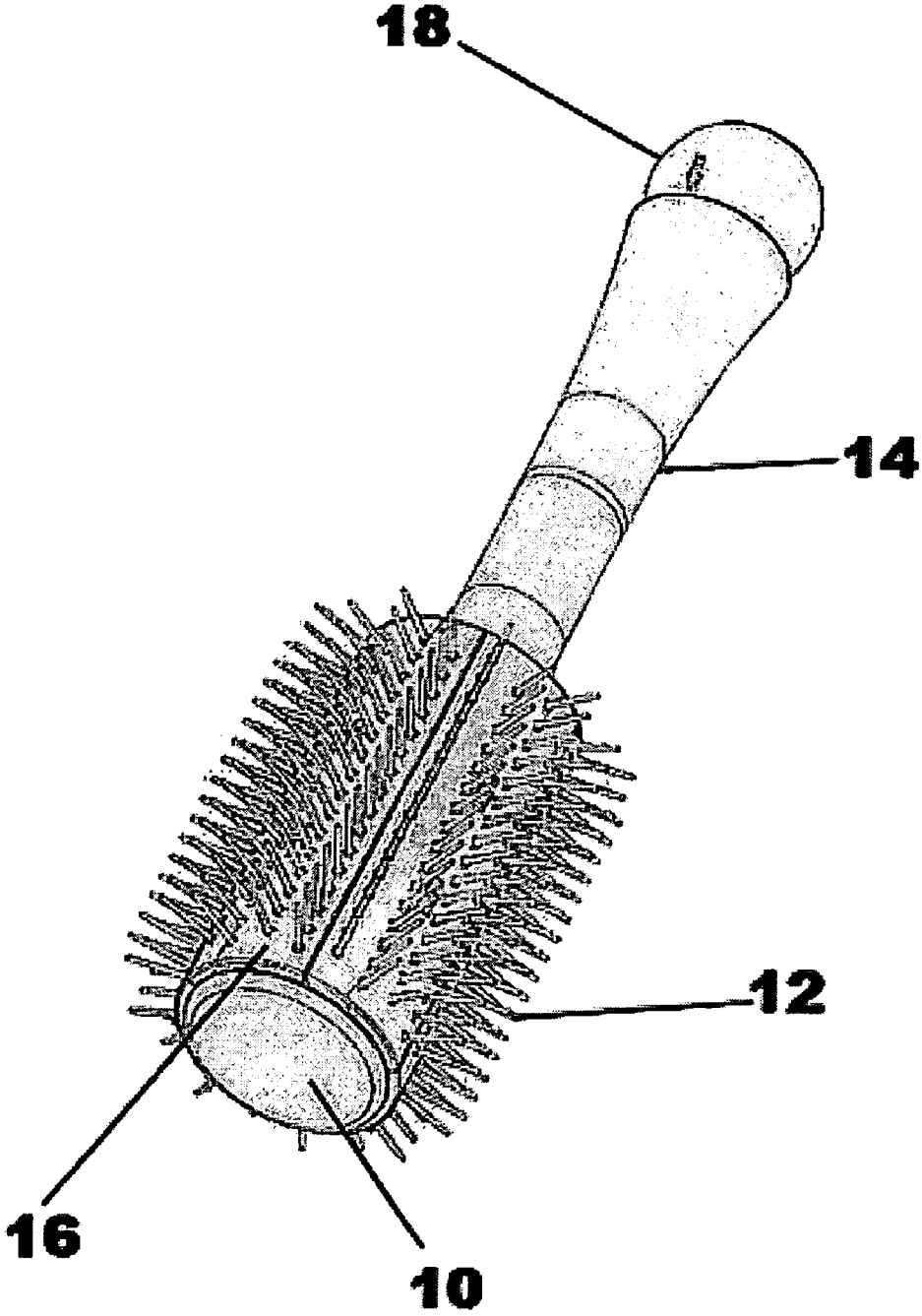
FIG. 1 is a schematic perspective view of the preferred embodiment of the present invention in a brushing position.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

In the preferred embodiment of the present invention, referring to FIG. 1, the hair brush has a hollow body 10 supporting numerous bristles 12 and a handle 14 connected to the body. The brush also has plate(s) 16 that are positioned flush to the brush body 10 such that the bristles 12 protrude through numerous openings 20 in the plate(s) 16. As the brush is used, hairs may become lodged among the bristles 12. The brush may then be cleaned by pulling the control element 18 outward, which moves the plate(s) 16, outward toward the tips of the bristles 12, thus pushing the entangled hair away from the body 10 and off the bristles 12.

Figure 2:
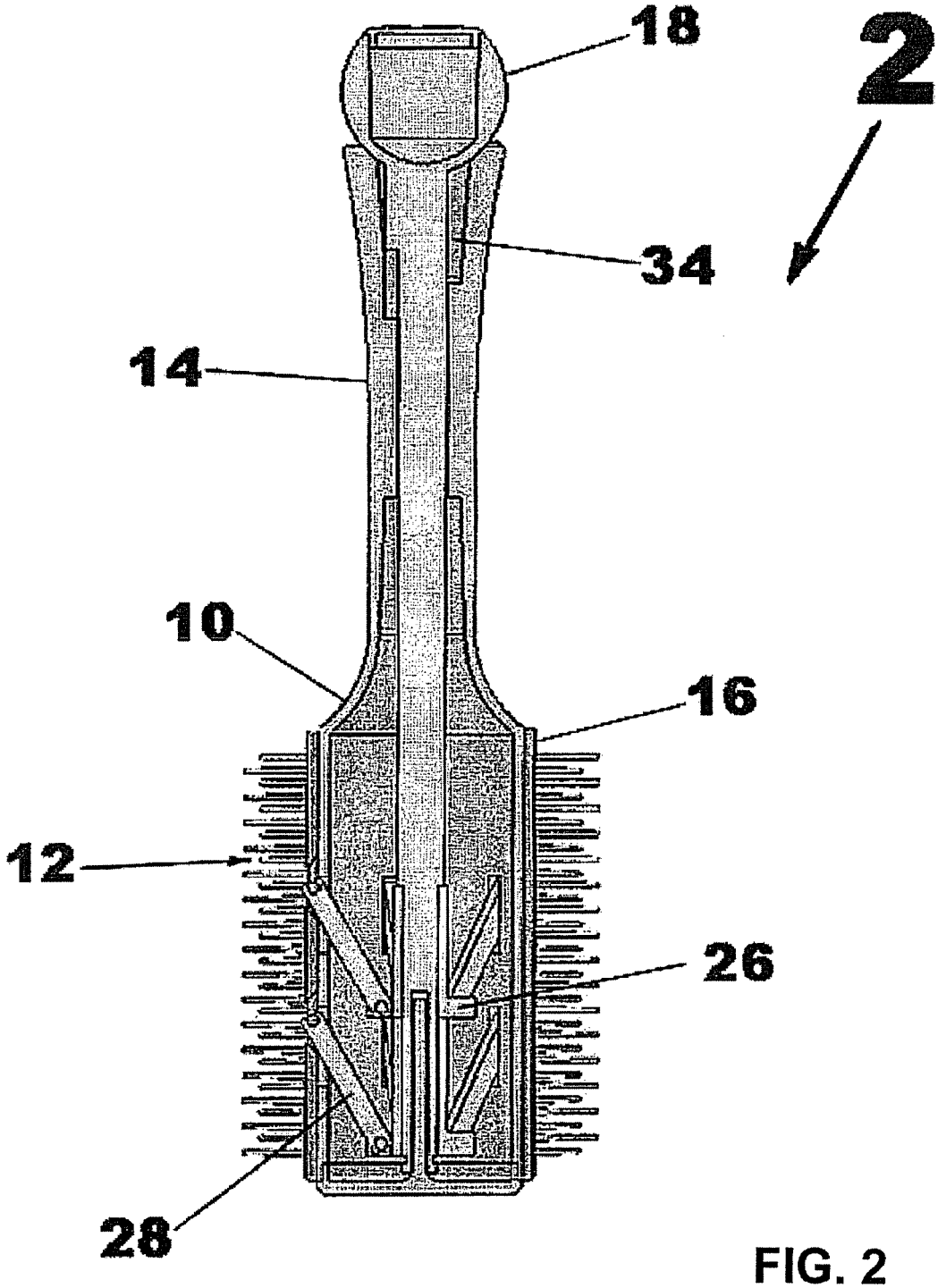
FIG. 2 is a cut away view of the preferred embodiment of the present invention showing the components thereof.
Figure 3:
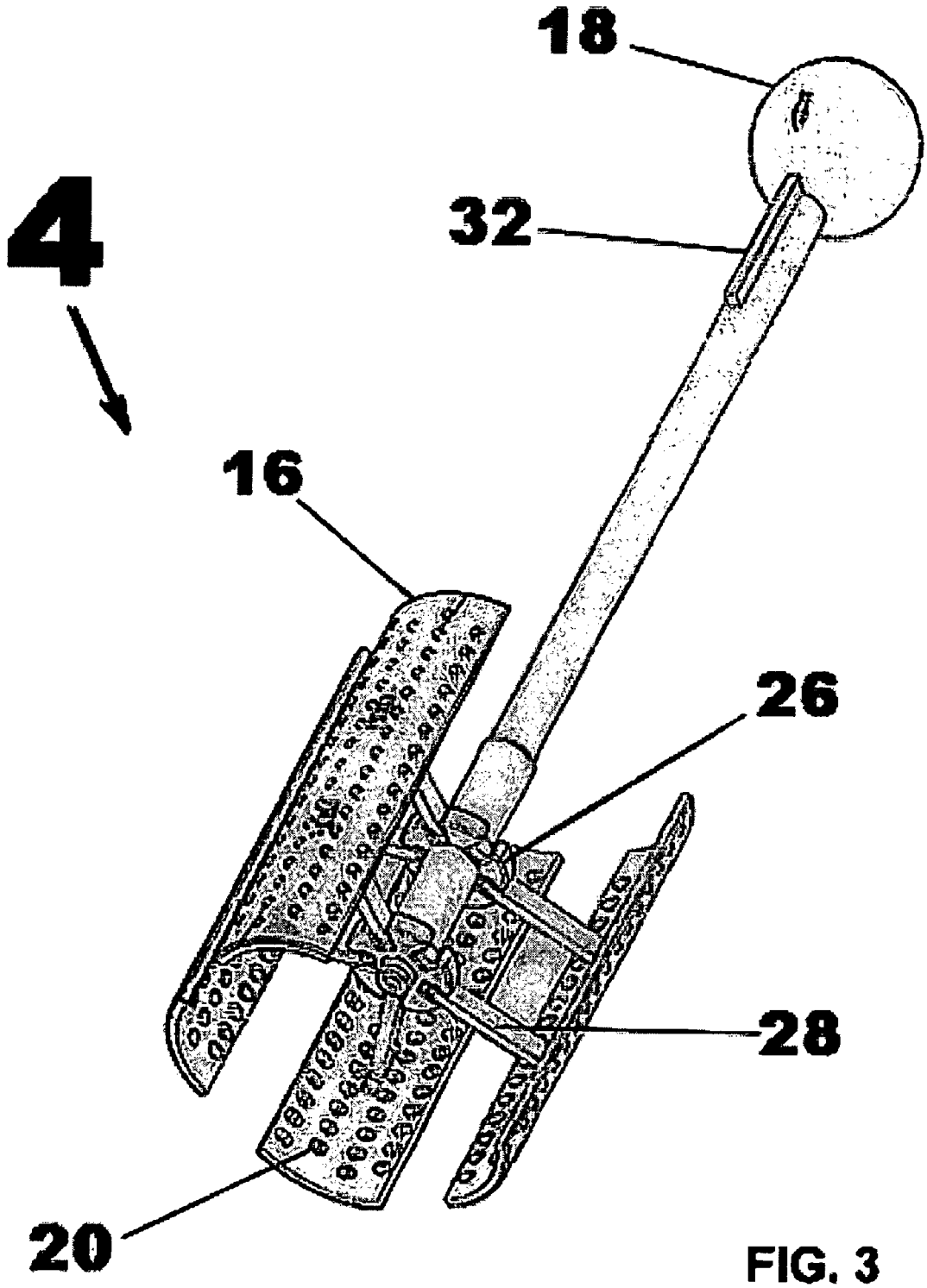
FIG. 3 is a partially exploded view of the preferred embodiment of the present invention showing the cleaning element components thereof with the hollow based body removed for clarity.

Referring to FIGS. 2 and 3, the hair brush can be comprised of three elements: a brushing element 2, a cleaning element 4, and a control element 18. The brushing element 2 has a hollow body 10 supporting an array of bristles 12, and handle 14. The body 10 is of a generally circular shape. The handle 14 is hollow and notched 34 on the inside to allow for adjustments to the length of the bristles 12. The handle 14 can be integrally formed with the body 10.

The body 10, handle 14, cleaning element 4, and control element 18, can be constructed from any substantially rigid material such as plastic, rubber, wood or metal. The bristles 12 are flexible and can be made of the same or different material as the body 10. Each bristle 12 can be a pin or clusters of pins. The bristles 12 can protrude from the body 10 at an angle instead of perpendicularly. The bristles 12 can be arranged in an array of straight columns and rows or arranged in an array of staggered rows.

The cleaning element 4 has plate(s) 16, plate lifters/rib arms 28 and a sleeve attachment 26. The plate(s) 16 are of the same general shape as the body 10 of the brushing element and have an array of openings 20, such that the bristles 12 are disposed through the openings 20. Each opening 20 can receive only one bristle 12. The plate lifters/rib arms 28 are positioned within the hollow body 10 of the brushing element. The plate lifters/rib arms 28 are attached to the sleeve element 26 and then to each plate(s) 16.

The control element 18 forms the end part of the handle of the hair brush. It has a round shape corresponding to the shape of the handle 14 of the brushing element 2. There are notched 34 steps inside the handle 14 of the brushing element 2. The end of the handle 14 where the control element 18 rests is numbered 0 through 5. These numbers 40 identify the different levels of notched 34 steps located inside of the handle 14. These notches 34 receive the parallel shaft 32 as set by the user in one of the six notches 40.

Figure 4:
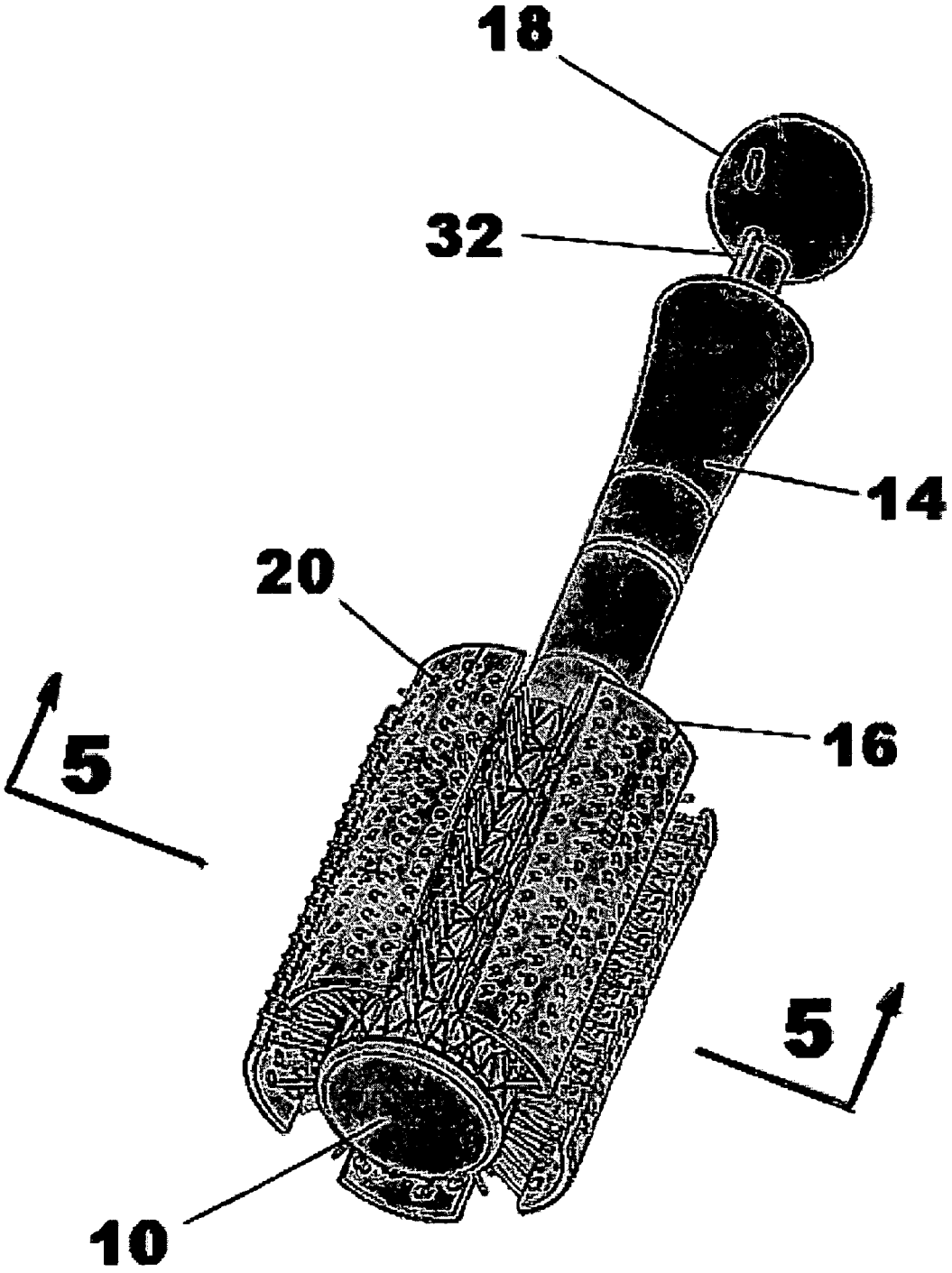
FIG. 4 is a schematic perspective view of the preferred embodiment of the present invention in the maximum cleaning position.

Referring to FIG. 4, after using the brush, the brush can be cleaned by pulling the control element 18 outward. Pulling on the control element 18 outward pulls the sleeve element 26 and plate lifters/rib arms 28 outward which moves the plate(s) 16 outward to the tips of the bristles 12. The control element is guided within the handle 14 of the brushing element 2. When the control element 18 is forward, the plate(s) 16 of the cleaning element 2 is approximately even with the tips of the bristles 12, such that the outer surface of the plate(s) 16 clears the tips of the bristles 12 while the inner surface of the plate(s) 16 remains engaged with the tips of the bristles 12. Thus the plate(s) 16 pushes any hairs that were entwined in the bristles 12 to the tips of the bristles 12 where hairs fall off or are removed. As a consequence the present design provides a means for varying a useful-length of respective bristles 12 and for cleaning bristles 12 using the presently noted plates 16, at least in part. The control element 18 is returned to a brushing position, where the bristles 12 protrude through the plate(s) 16, by pushing in control element 18 back into the handle 14 of the brush element 2.

Figure 5:
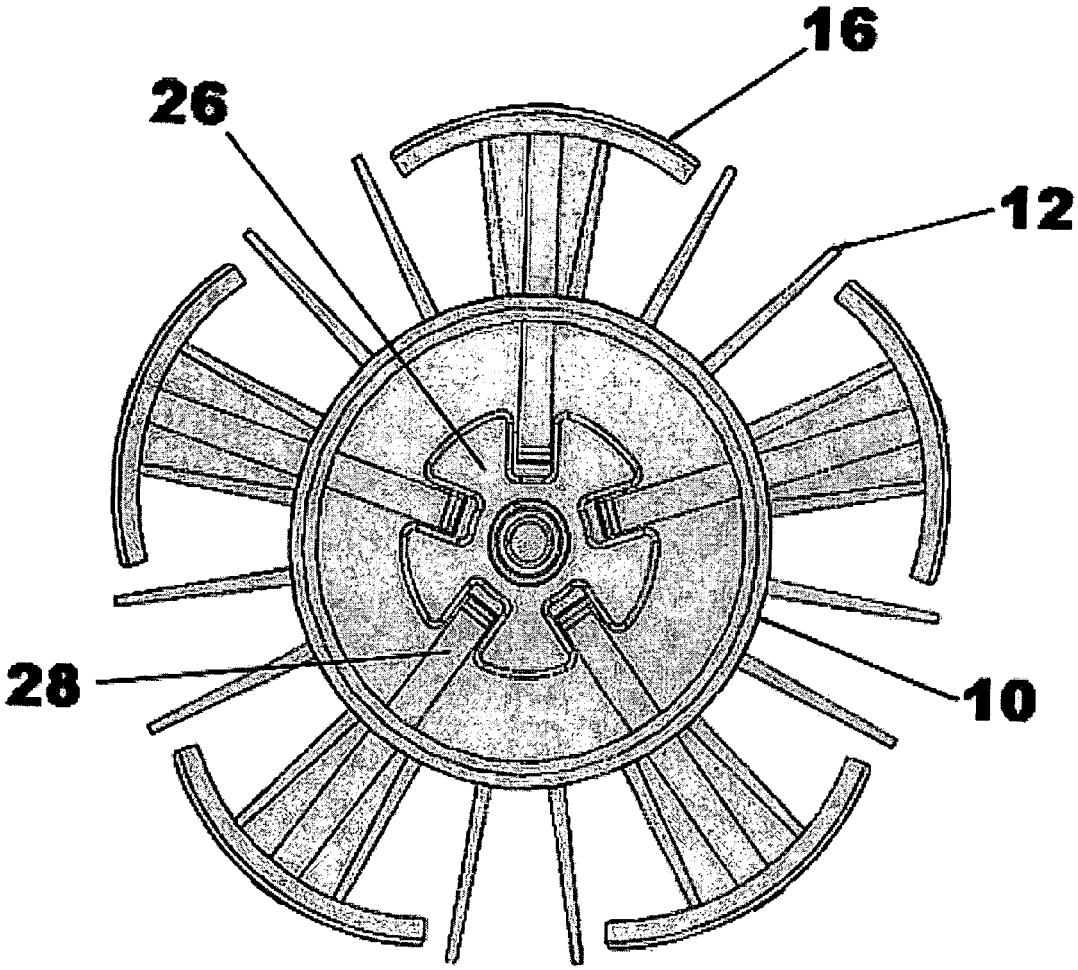
FIG. 5 is a cross-sectional view of the preferred embodiment of the present invention along the line 5-5 of FIG. 4 shown in a maximum cleaning condition.
Figure 6:
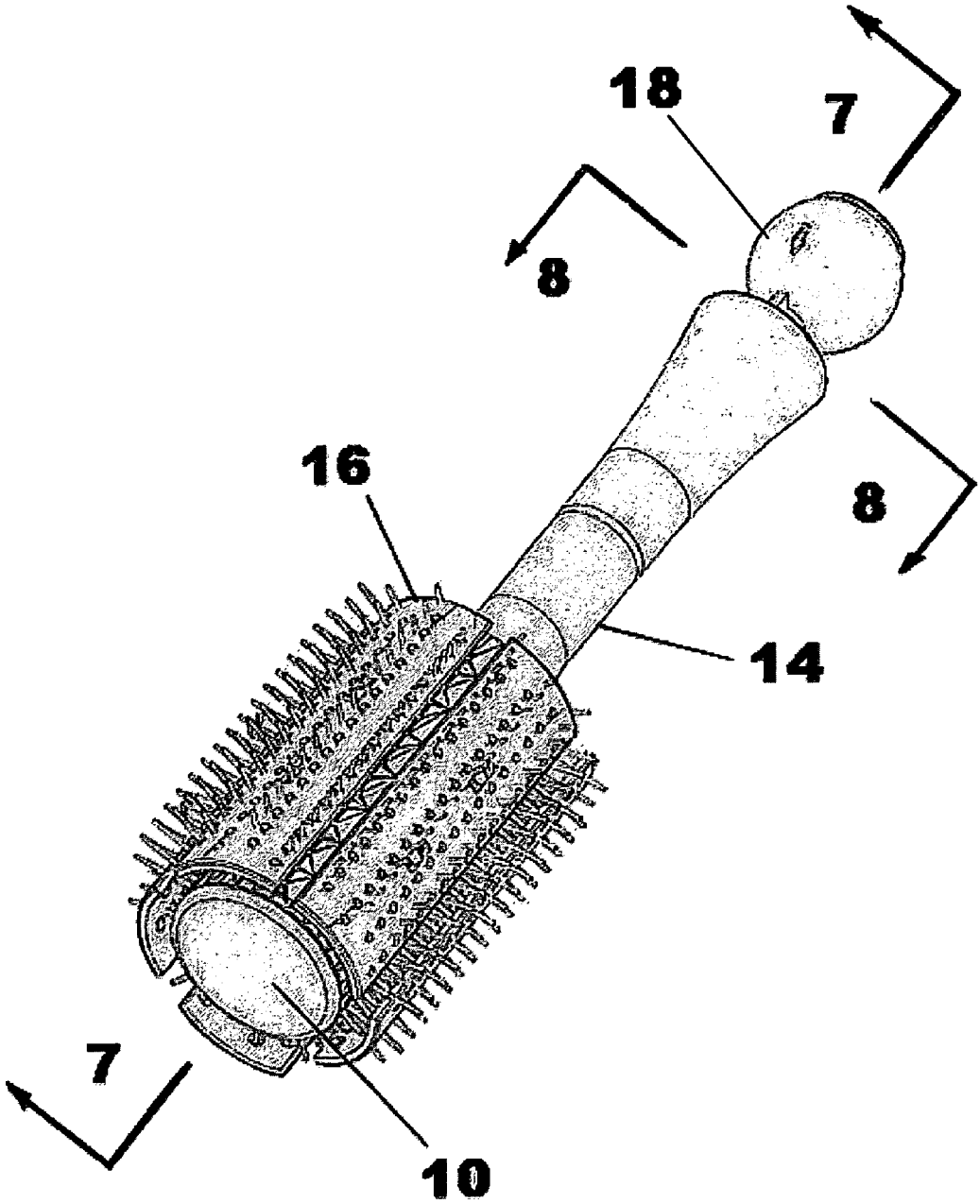
FIG. 6 is a schematic perspective view of the preferred embodiment of the present invention in an alternate brushing use position.

Referring now to FIG. 5, wherein a partial cross-sectional view along line 5-5 in FIG. 4 notes bristles 12 extending radially outwardly from a central portion of brush head element and hollow body 10. As can also be seen from reviewing FIG. 3, cantilever portions extending from plate(s) 16 contact respective plate lifters/rib arms 28 and move plates 16 radially outwardly along the direction of each bristle.

Those of skill in the art will appreciate that openings 20 may be of any shape effective to achieve the goals of the present invention. As a consequence of this realization, while holes 20 are shown to be substantially circular in FIG. 3, those of skill in the art will appreciate that various shaped openings may be used, including oblong, ovoid, rectilinear, tapered along a depth of plate(s) 16, and other shapes effective to both clean hair from bristles 12 and minimizing flexing of bristles 12 during a motion of plate(s) 16 along the length of each bristle. As a consequence, it will be appreciated in FIG. 5, that plate(s) 16 are not intended to cause flexing of bristles 12 during operation, thus improving hair removal and bristle life.

It will also be noted from FIG. 5, that where plate(s) 16 end along a row of bristles 12, holes 20 may partially exist on each respective plate (for example as a ½-circle or semi-ovoid). Thus, as noted in FIG. 1, plate(s) 16 may have joints between rows of bristles 12, and as noted in FIGS. 4 and 5, plate(s) 16 may have joints that end on a row of bristles 12, all without departing from the scope and spirit of the present invention. Since plate(s) 16 operate along a length of respective bristles 12 either construction will operate effectively to remove hair and to moderate/adjust a useful bristle length, as will be discussed below.

The brush has multiple brushing positions. The cleaning element 4 can be raised so that its plate(s) 16 is/are substantially flush with the body 10 of the brushing element 2. In this position, the bristles 12 are at their full length. To set the brush to this first brushing position, the parallel shaft 32 is positioned within the lowest of the notched 34 steps. The parallel shaft 32 is set by pulling and turning the control element 18 in the appropriate direction to the targeted notch 34. Upon release of the pressure, the parallel shaft 32 engages within one of the notches of the handle 14. In addition, the plate(s) 16 can be adjusted to a plurality of intermediary fixable positions between the first brushing position (FIG. 1) and the cleaning position (FIG. 4). For example, the four intermediary positions set the plate(s) 16 at varying distances, e.g. ⅕ and ⅖ distance from the body 10. The effect of the intermediary positions is to vary the usable and operable length of respective bristles 12, i.e. long, medium and short.

Figure 7:
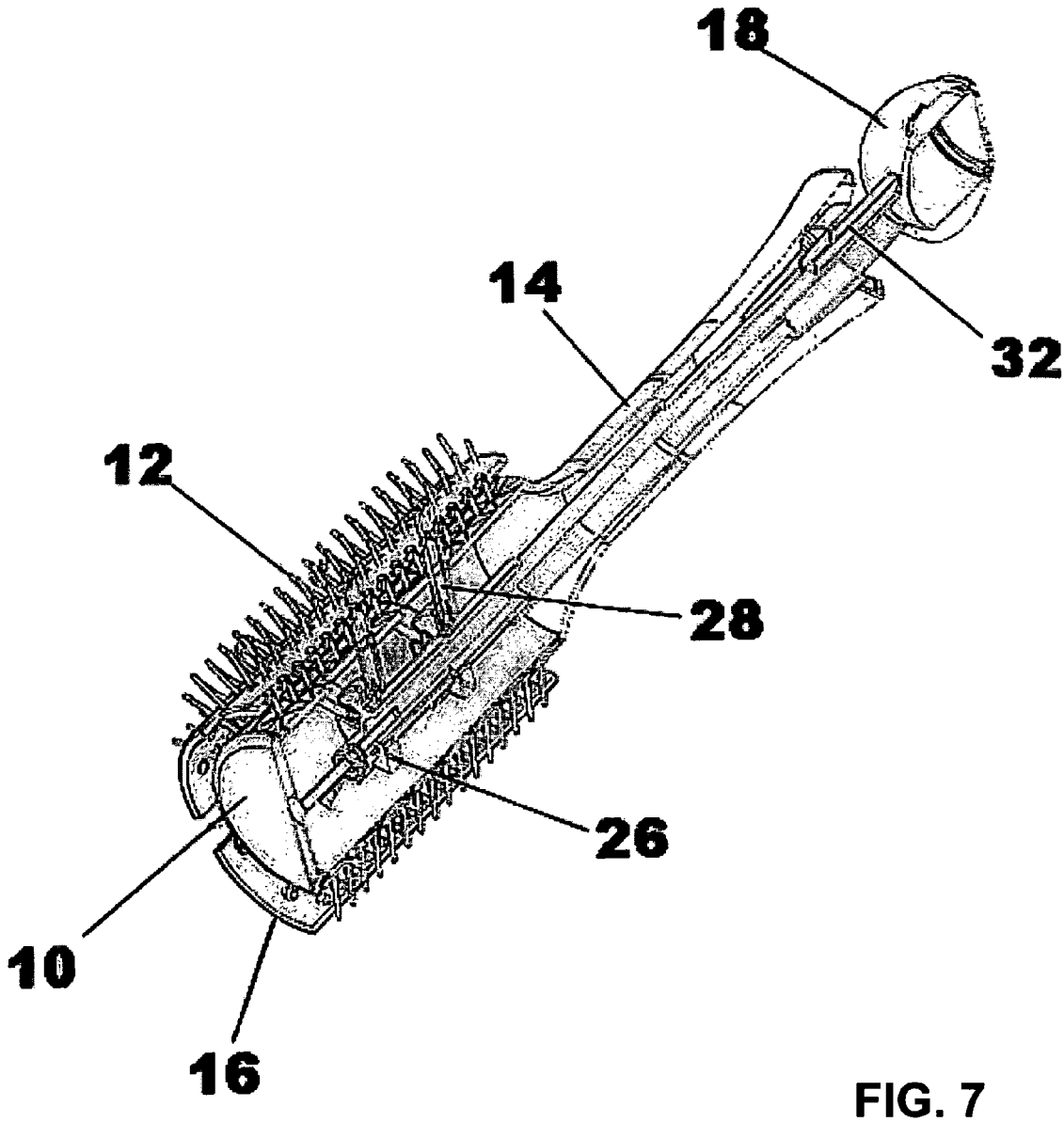
FIG. 7 is a schematic cross-sectional view of the preferred embodiment of the present invention along the line 7-7 of FIG. 6.
Figure 8:
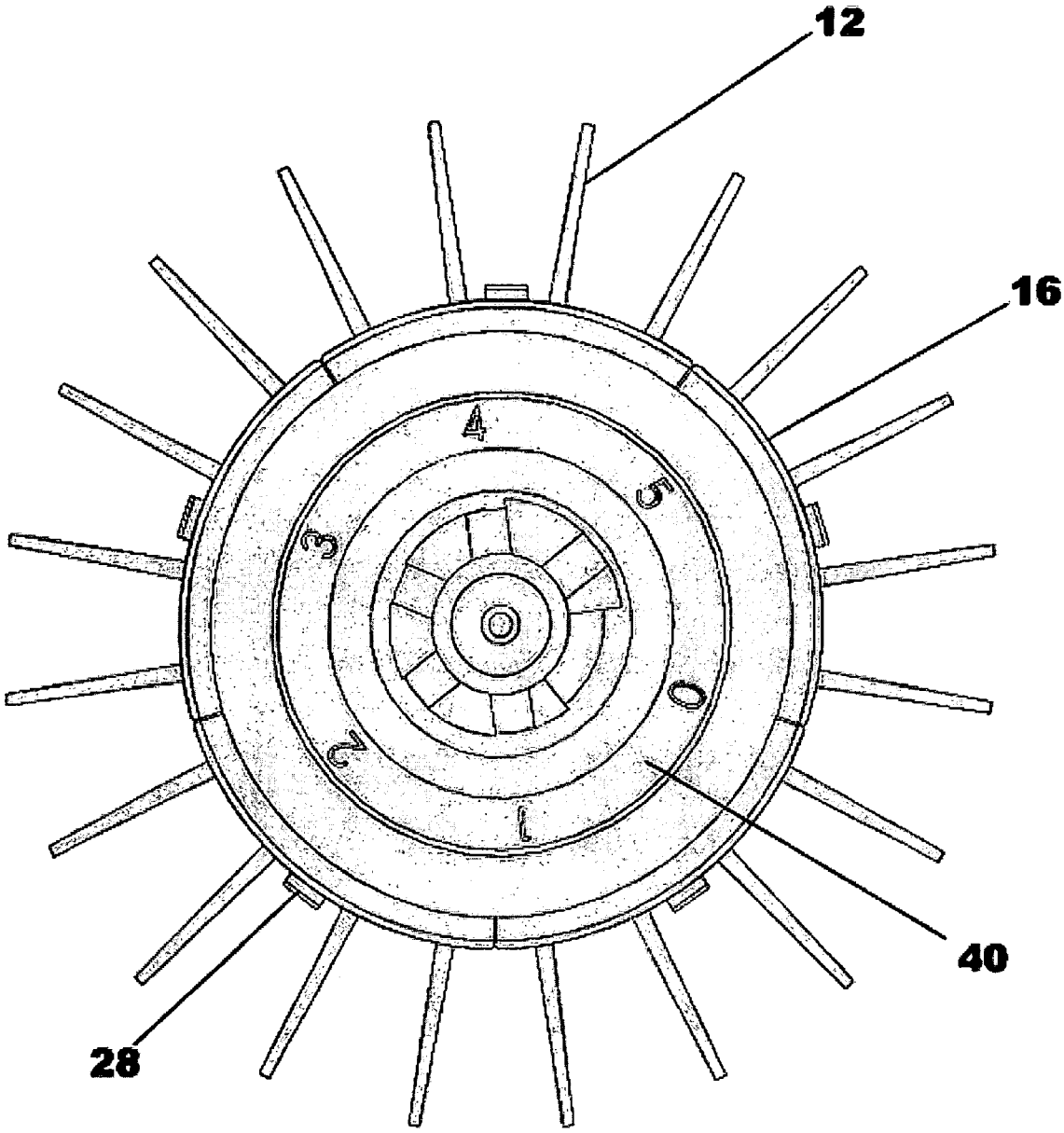
FIG. 8 is a cross-sectional view of the preferred embodiment of the present invention along the line 8-8 of FIG. 6.

Referring now to FIG. 7, when the parallel shaft is set to the notch 1, the plate(s) 16 is/are secured away from the body 10 at a distance of approximately ⅕ the full length of the bristles. Setting the parallel shaft 32 to level 1 effectively reduces the bristles 12 to a short length. The combination of the parallel shaft 32 and the notched 34 opening forms a locking mechanism because when the parallel shaft 32 is disposed within any of the notches 34, the cleaning element 4 is locked in position relative to the control element 18.

From any brushing position the brush can be cleaned by pulling the control element 18 outwardly away from the brush head, which in turn moves the cleaning element 4, plate(s) 16 to the tips of the bristles 12 thereby removing the entangled hairs. After cleaning the brush, the plate(s) 16 of the cleaning element 4 are returned to a brushing position by pushing the control element 18 inward to the desired bristles 12 length.

As a consequence of the present description, in combination with the drawings, it should be readily understood by those of skill in the art that an operation of the cleaning elements relative to the brushing elements enables a mechanism or system for stripping or removing loose hair from bristles 12 in a direction substantially parallel to a bristle direction without requiring a bending or flexing of the bristles thereby minimizing a bristle flex stress during a cleaning step.

As to the manner of usage and operation of the present invention, the same should be apparent from the above description. Accordingly, no further discussion relating to the manner of usage and operation will be provided.

With respect to the above description then, it is to be realized that the optimum dimensional relationships for the part of the inventions, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A self-cleaning hair brush comprising, in combination:

a brushing element including a body, a plurality of bristles extending radially outward from a central axis of the body, the plurality of bristles being supported by the body and a handle supported by the body;

a cleaning element substantially surrounding the body of the brushing element, the cleaning element including a plurality of plates, each plate having a plurality of openings positioned relative to the bristles, a plate lifter/rib arms and a sleeve/spacer which supports the plurality of plates, and is disposed within the body of the brushing element; and a control element engaged with the plate lifter of the cleaning element which allows for the extraction of the control element at the end of the handle, wherein the plate lifter, spacer, and control element are configured and adapted to expand the plurality of plates radially outward from the body of the brushing element to facilitate removal of hairs therefrom when the control element is moved from a brushing position to a cleaning position, and wherein the plate lifter, spacer, and control element are configured and adapted to contract the plurality of plates radially inward toward the body of the brushing element to facilitate hair brushing when the control element is moved from the cleaning position to the brushing position.

2. The hair brush, according to claim 1, wherein the cleaning element is moveable with respect to the brushing element between a brushing position and a cleaning position, in the brushing position the plate(s) is/are flush with the brushing element such that the plurality of bristles protrude through the plurality of openings in the plate(s).

3. The hair brush, according to claim 2, wherein in the cleaning position the plate(s) is/are situated about the tips of the bristles (maximum cleaning position).

4. The hair brush, according to claim 1, wherein the cleaning element is movable with respect to the brushing element between a brushing position and a cleaning position, wherein the cleaning element is movable responsive to an external force applied to the control element.

5. The hair brush, according to claim 4, wherein the cleaning element is movable responsive to release of the external force applied to the control element.

6. The hair brush, according to claim 2, further comprising:

a locking element within the control element and the cleaning element to selectively lock the cleaning element in at least one intermediate position between the brushing position and the cleaning position producing different effective length of bristles at each intermediate position.

7. The hair brush, according to claim 2, further comprising:

means for locking the control element relative to the cleaning element to selectively maintain at least one intermediate position so that the cleaning element is moveable between the intermediate position and the cleaning position upon operation of the control element.

8. The hair brush, according to claim 7, further comprising:

means for returning the cleaning element to a locked intermediate position after the control element has been operated to the maximum cleaning position.

9. The hair brush, according to claim 1, where in the plurality of bristles are disposed in staggered rows.

10. A brush, comprising:

a handle portion and a bristle head portion arranged in-line along a long direction of said brush;

a plurality of bristles on said bristle head portion projecting outwardly in a bristle direction generally orthogonal to said long direction of said brush;

said bristles having at least a first use-length available for brushing during a use of said brush; and means for removing external hair from said bristles following said use, wherein said means for removing includes at least a first cleaning element operable outwardly along said bristle direction, thereby minimizing a risk of bristle damage, wherein the cleaning element includes a plurality of cleaning plates configured and adapted to move apart from one another while moving outward from the bristle head portion of the brush to facilitate removal of hair from the bristles.

11. A brush, according to claim 10, further comprising:

means for selecting between said first use-length and at least a second use-length of at least one of said plurality of bristles during said use, whereby at least one alternate bristle use-length is available.

12. A brush, according to claim 11, further comprising:

lock means for releasably and lockably selecting between at least said first and said second use-length of said bristles during a use, thereby increasing a convenience of said brush.

13. A brush, according to claim 10, further comprising:

spring assembly means for elastically urging said at least first cleaning element inwardly along said bristle direction, thereby speeding a return of said at least first cleaning element to a use position following a cleaning of said brush.

14. A brush, according to claim 12, further comprising:

sleeve/spacer assembly means for elastically urging said at least first cleaning element inwardly along said bristle direction; a control element operable in both said lock means for releasably and lockably selecting and said sleeve/spacer means;

said control element operable along said long direction of said brush; and said control element enabling a ready positioning of said at least first cleaning element to establish at least said first and said second use-lengths of said bristles.

15. A method for cleaning a hair brush, comprising the steps of:

selecting a brush assembly having a handle portion and a bristle head portion arranged generally aligned along a long direction of said hair brush;

said brush assembly wherein:

said bristle head portion includes a plurality of bristles on said bristle head portion projecting radially outwardly from the bristle head portion in a bristle direction generally orthogonal to said long direction of said brush;

said bristles having at least a first use-length available for brushing during a use of said brush;

said brush assembly including means for removing external hair from said bristles following said use;

said means for removing including a plurality of cleaning elements operable outwardly along said bristle direction, thereby minimizing a risk of bristle damage and a control element projecting from said handle portion slidable along said long direction to drive said first cleaning element outwardly, wherein the cleaning elements and the control element are configured and adapted to expand the plurality of cleaning elements radially outward from the bristle head portion of the brush assembly to facilitate removal of hairs therefrom when the control element is moved from a first position to a second position, and wherein the cleaning elements and control element are configured and adapted to contract the plurality of cleaning elements radially inward toward the bristle head portion of the brush assembly to facilitate hair brushing when the control element is moved from the second position to the first position;

holding said handle portion; and sliding said control element along said long direction and moving said first cleaning element outwardly along said cleaning direction of said hair brush to remove said external hair from said bristles.

* * * * *